US006941861B2

(12) United States Patent
Bitterich et al.

(10) Patent No.: US 6,941,861 B2
(45) Date of Patent: Sep. 13, 2005

(54) PRINTING PRESS HAVING A ROLLER MAGAZINE

(75) Inventors: Wolfgang Bitterich, Gemmingen (DE); Michael Schwandt, Heidelberg (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 16 days.

(21) Appl. No.: 10/424,348

(22) Filed: Apr. 28, 2003

(65) Prior Publication Data

US 2003/0200883 A1 Oct. 30, 2003

(30) Foreign Application Priority Data

Apr. 26, 2002 (DE) ..... 102 19 300

(51) Int. Cl.[7] ..... B41F 5/00
(52) U.S. Cl. ..... 101/216; 101/480
(58) Field of Search ..... 101/148, 157, 101/169, 216, 349.1, 350.6, 351.1, 351.7, 366, 479, 480

(56) References Cited

U.S. PATENT DOCUMENTS

| | | | | |
|---|---|---|---|---|
| 3,601,049 A | | 8/1971 | Hamilton | |
| 4,528,907 A | * | 7/1985 | Davison | 101/219 |
| 5,154,602 A | | 10/1992 | Harrison | |

FOREIGN PATENT DOCUMENTS

| | | |
|---|---|---|
| DE | 1 140 205 | 11/1962 |
| DE | 198 19 389 A1 | 2/1999 |
| DE | 101 23 324 C1 | 8/2002 |

* cited by examiner

*Primary Examiner*—Ren Yan
(74) *Attorney, Agent, or Firm*—Laurence A. Greenberg; Werner H. Stemer; Ralph E. Locher

(57) ABSTRACT

A printing press includes a cylinder, rollers each being selectively displaceable into an active position on the cylinder, a roller magazine for the rollers, and a protective cover for the roller magazine. The protective cover is mounted so as to be adjustable movably between the roller magazine and a respective one of the rollers that has been displaced into the active position.

21 Claims, 4 Drawing Sheets

PRINTING PRESS HAVING A ROLLER MAGAZINE

BACKGROUND OF THE INVENTION

Field of the Invention

The invention relates to a printing press having a cylinder, rollers each being selectively displaceable into an active position on the cylinder, a roller magazine for the rollers, and a protective cover for the roller magazine.

U.S. Pat. No. 5,154,602 describes a printing press of that general type, wherein a roller magazine is constructed as a rotatably mounted turret magazine, and the protective cover is constructed as a swivellably mounted covering shell. A disadvantage of that printing press is that the rollers located in the roller magazine can be cleaned only when the printing press is at a standstill. The efficiency of the printing press is markedly impaired due to the frequent times for stoppage of the printing press associated with the cleaning of the rollers in the roller magazine.

German Published, Non-prosecuted Patent Application DE 198 19 389 A1, wherein a printing press having a roller magazine and a lifting device for displacing the rollers from the roller magazine into an active position is described, is unable to contribute to a solution for this problem.

SUMMARY OF THE INVENTION

It is accordingly an object of the invention to provide a printing press having a roller magazine, which overcomes the hereinafore-mentioned disadvantages of the heretofore-known devices of this general type and which is consequently easier to maintain.

With the foregoing and other objects in view, there is provided, in accordance with the invention, a printing press comprising a cylinder, rollers each being selectively displaceable into an active position on the cylinder, a roller magazine for the rollers, and a protective cover for the roller magazine. The protective cover is mounted in such a way as to be adjustable movably between the roller magazine and a respective one of the rollers having been displaced into the active position.

In accordance with another feature of the invention, the cylinder is a form or blanket cylinder.

In accordance with a further feature of the invention, the rollers are screen rollers.

In accordance with an added feature of the invention, the roller magazine is a rotatably mounted turret magazine, and the printing press includes a lifting device associated with the roller magazine for displacing the rollers from the roller magazine into the active position. The lifting device has wheels mounted coaxially with the roller magazine.

In accordance with an additional feature of the invention, the wheels are chain sprockets.

In accordance with yet another feature of the invention, the roller magazine has a hollow axle. The wheels of the lifting device have a drive shaft guided through the hollow axle.

In accordance with yet a further feature of the invention, the hollow axle is an axle journal.

In accordance with yet an added feature of the invention, the printing press further includes a worm gear mechanism connected to the drive shaft for driving the drive shaft.

In accordance with yet an additional feature of the invention, the printing press further includes another worm gear mechanism connected to the roller magazine for driving the roller magazine.

In accordance with a concomitant feature of the invention, the worm gear mechanisms are disposed on mutually opposite sides of the roller magazine.

As noted hereinbefore, the heretofore-known general construction of the printing press described in the introduction hereto is provided, in accordance with the invention, with a protective cover mounted so as to be movable adjustably between a roller magazine and a respective roller that has been displaced into an active position.

In the case of the printing press according to the invention, the protective cover, when it is being closed, is moved into a protective position which is situated between the roller magazine and the roller that has been displaced against or into engagement with the cylinder. It is advantageous that the protective cover can be kept closed as the printing press is operating or running while using the roller displaced from the roller magazine into the active position. During printing operation, the protective cover can extend between the roller magazine and the roller which is in the active position and participating in the printing operation. The printing press according to the invention is very easy to maintain because manipulations at the roller magazine and at the at least one roller, which is not in the active position and has remained in the roller magazine in a passive position, are possible, even during a printing operation. For example, the roller remaining in the roller magazine can be cleaned or replaced by another roller during a printing operation. Cleaning agent or residual ink dripping from the roller remaining in the roller magazine cannot pass to the other roller participating in the printing operation in the active position, because the protective cover reliably collects the dripping residual ink or the dripping cleaning agent. In the printing press according to the invention, however, not only is protection afforded to the roller located in the active position against disturbances originating from the roller magazine, but also to the roller magazine and the roller or rollers located therein against disturbances originating from the roller rotating in the active position. The protective cover shields the roller magazine and the roller or rollers located therein against spraying or misting-off of printing ink from the roller located in the active position and rotating rapidly during printing.

Within the context of the invention of the instant application, a printing press is understood to be a machine by which a printing material in the form of a web or preferably sheets is printed with a printing ink, varnished with a clear varnish or coated with a coating liquid, e.g., a white primer. The roller magazine may be mounted so as to be displaceable linearly into various magazine positions, and configured as a drawer. The protective cover may be mounted so as to be linearly displaceable from a position wherein the protective cover is moved out from an interspace between the roller magazine and the roller displaced into the active position, into a protection position, and constructed as a smooth-surfaced, plate-shaped protective shield. However, the protective cover is preferably configured as a protective hood or protective shell and mounted so as to be swivellable around the roller magazine into the protection position. The roller magazine includes at least two rollers, one of which is in the active position and the other is in the roller magazine as a reserve roller during the printing operation. The roller magazine is therefore equipped with at least two roller accommodation spaces, e.g., roller compartments, one of which, during printing operation, is empty and the other is occupied by the reserve roller. The roller magazine preferably includes more than two rollers, namely the roller located in the active position during a printing operation, and two or preferably three reserve rollers stored in the roller magazine at the same time during a printing operation, and accordingly the roller magazine has at least three and preferably four roller accommodation spaces. The cylinder of the printing press according to the invention, on or against which the roller is set in the active position, may be a form and/or blanket cylinder for printing, varnishing or coating. For example, the cylinder may be configured structurally so that a flexographic printing plate for spot varnishing or a rubber blanket for varnishing the entire area may selectively be clamped onto the cylinder. The rollers belonging to the roller magazine may be anilox or engraved or screen rollers which differ from one another in terms of the engraving thereof. The screens or rulings of the engraved rollers may differ, for example in terms of the engraving fill volume thereof, one of the rollers having a large engraving fill volume and being suitable for print orders requiring a large quantity of printing ink, varnish or the like, and the other roller having a small engraving fill volume and being suitable and used for print orders requiring a small quantity of printing ink, varnish or the like.

In one development according to the invention, the roller magazine is configured as a rotatably mounted turret magazine, which may also be called a drum storage, and a lifting device is assigned to the roller magazine for displacing the rollers from the roller magazine into the active position, the lifting device including wheels which are mounted coaxially with the roller magazine. This development is advantageous in many respects. Moving the entire roller magazine for the purpose of displacing the selected roller into the active position is obviated by the presence of the lifting device, by the aid of which, the roller, respectively, selected for the printing operation is removed from the roller magazine and later reinserted into the roller magazine. While the selected roller is being displaced into the active position by the lifting device, the roller magazine remains in the fixed installation position thereof within the printing press. Much less drive power is necessary for transporting the selected roller out of the roller magazine and to the cylinder than would be the case if the selected roller remained in the roller magazine during movement thereof into the active position and had to be displaced together with the roller magazine. In accordance with the development described here, the roller magazine is mounted so as to be rotatable about a geometric axis of rotation, the wheels of the lifting device also being mounted so as to be rotatable about the axis of rotation. The coaxial mounting of the wheels of the lifting device and the roller magazine results in advantages with regard to a compact construction and access to the roller magazine. The lifting device is preferably constructed as a flexible drive mechanism having at least one finite, i.e., non-closed, pulling member. The flexible drive mechanism preferably includes two such finite pulling members. If only one pulling member is present, it can then at least partly wrap or loop around both wheels. If two pulling members are present, each of the two pulling members then at least partly wraps around one of the two wheels. The flexible drive mechanism may be a capstan, for example, if the pulling member is a cable. However, the pulling member or members are preferably chains, and the flexible drive mechanism is accordingly a chain mechanism. If a chain or chains are used, it is then advantageous to construct the wheels as toothed chain sprockets which engage in the chain or chains of the lifting device.

A further development wherein a drive shaft of the wheels is guided through a hollow axle of the roller magazine is also advantageous with regard to a compact construction. The hollow axle may penetrate or extend through the roller magazine and project out of the roller magazine at the two opposite sides of the latter. Preferably, however, the hollow axle is one of two axle journals of the roller magazine, which are tubular in configuration.

In a further development, a first worm gear mechanism is connected to the drive shaft to drive the latter. The first worm gear mechanism may be connected to the drive shaft by a direct or indirect mechanism. In the case of a direct connection, a worm gear of the first worm gear mechanism is disposed coaxially with the drive shaft and is firmly connected to the latter so as to rotate therewith. In this regard, the worm gear may sit firmly on the drive shaft. In the case of an indirect connection, at least one further gear mechanism stage is disposed between the worm gear of the first worm gear mechanism and the drive shaft. For example, a gear can sit firmly on the drive shaft and engage with first toothing of the worm gear, the worm gear having second toothing, the teeth of which are in mutual engagement with a worm of the first worm gear mechanism. An advantage relating to the safety of the lifting device results from the presence of the first worm gear mechanism. The first worm gear mechanism can be configured to be self-locking so that the selected roller cannot fall from the roller magazine into the active position or from the active position into the roller magazine while it is being transported by the lifting device, and be damaged in the process if, for example, an electric motor driving the first worm gear mechanism fails during a power supply disruption at a point in time at which the selected roller is located between the roller magazine and the active position. The first worm gear mechanism is also advantageous, with regard to manual drive of the lifting device as an alternative to the motor drive, due to the large gear reduction thereof. The operator need not apply any excessively large operating forces during the manual displacement of the roller out of the roller magazine into the active position or from the active position into the roller magazine by the lifting device, and also need not fear that the selected roller may fall of its own inherent weight and take parts of the lifting device, e.g., the chain, with it, in the process, if a hand crank or the like of the lifting device is suddenly released.

According to a further development, another or second worm gear mechanism is connected to the roller magazine and serves for driving the latter. The second worm gear mechanism may be connected to the roller magazine directly or indirectly in a manner analogous to the connection of the first worm gear mechanism to the drive shaft. The fact that the second worm gear mechanism is self-locking is advantageous with regard to securing the roller magazine against unintended rotation. The second worm gear mechanism thus forms a safety device which maintains the roller magazine in the rotary position set by the second worm gear mechanism until the second worm gear mechanism is again driven manually or by motor. It is believed to be readily apparent that it is also possible to use the second worm gear mechanism in the case of the printing press according to the invention without using the first worm gear mechanism. Instead of the first worm gear mechanism, in this case, a different gear mechanism may be used for driving the drive shaft.

In the case of a development which is advantageous with regard to the optimal use of the installation space available on both sides of the roller magazine, the gear mechanism used for rotatively driving the drive shaft, e.g., the first worm gear mechanism, and the gear mechanism used for rotatively driving the roller magazine, e.g., the second worm gear mechanism, are disposed on the two mutually opposite sides of the roller magazine adjacent to the latter.

Other features which are considered as characteristic for the invention are set forth in the appended claims.

Although the invention is illustrated and described herein as embodied in a printing press having a roller magazine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
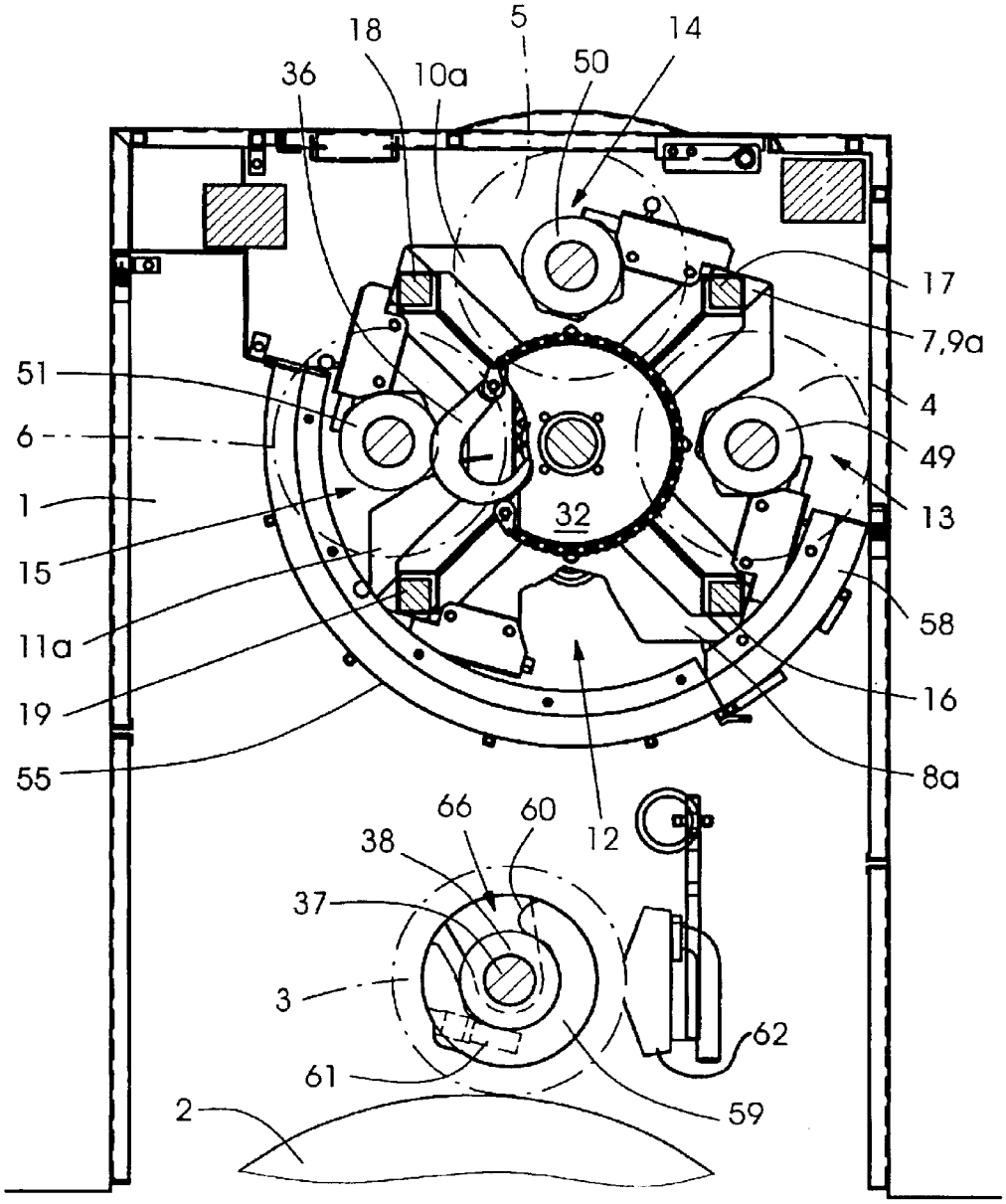
FIG. 1 is a diagrammatic, side-elevational and partly sectional view of a rotary printing press with a turret-shaped roller magazine and a shell-shaped protective cover during a printing operation, with the sectional view being taken along a line I—I of hereinafter described FIG. 3, in the direction of the arrows.

Referring now to FIGS. 1 to 4 of the drawings as a whole, there are seen details of a sheet-fed rotary printing press 1. The printing press 1 includes a printing unit provided for varnishing sheets of printing material. Further included are otherwise non-illustrated offset printing units. The printing unit that is shown includes a form and/or blanket cylinder 2 which, together with an otherwise non-illustrated impression cylinder, form a printing nip therebetween. A flexographic printing plate for spot varnishing, or a blanket for full area varnishing or, alternatively and selectively, respectively, both cylinder coverings (flexographic printing form, blanket) are clampable on the form and/or blanket cylinder 2. The printing unit furthermore includes anilox, engraved or screen rollers 3 to 6, and a drum or turret magazine 7 for storing the screen rollers 4 to 6 not required at this point for the respectively then current print order. The screen rollers 3 to 6 differ from one another in the structures thereof and/or the fill volumes of their cell pattern or line pattern.

The turret magazine 7 is subdivided by carrying arms 8*a* to 11*a* and 8*b* to 10*b*, which form two end star profiles, into holding compartments 12 to 15 for the screen rollers 3 to 6. The star profiles 3 to 6 are connected to one another by crossmembers 16 to 19, and the holding compartments 12 to 15 are each lined with a respective collecting trough 20 to 23. The collecting troughs 20 to 23 catch cleaning fluid or residual ink dripping from the screen rollers 4 to 6, which are held in the turret magazine 7. The turret magazine 7 is equipped with a hollow, first axle journal 24 and with an opposite and likewise hollow, second axle journal 25 which serve for rotatably mounting the turret magazine 7 in side walls 26 and 27 of the printing unit, and define a geometric rotational axis 28 about which the turret magazine 7 is rotatable.

The rotation of the turret magazine 7 about the rotational axis 28 into the rotary position respectively necessary for removing, cleaning, or for introducing or replacing one of the screen rollers 3 to 6 is driven by a self-locking worm gear mechanism which includes a first worm gear 29, seated firmly on the first axle journal 24 so as to be fixed against rotation relative thereto, and a first worm 30 which is in meshing engagement with the first worm gear 29.

A lifting device ensures that each of the screen rollers 3 to 6, upon demand, can be displaced out of the turret magazine 7 into an active position and later back into the turret magazine 7. The lifting device includes two chain-pull mechanisms, each of which holds a different one of the two roller ends of the respective screen roller to be transported, this being, for example, the screen roller 3 in FIG. 2. The chain-pull mechanisms, respectively, have a chain sprocket 31, 32 with a circular segment shape and an open (chain ends unconnected to one another) chain 33, 34. The chain sprockets 31, 32 sit firmly on a drive shaft 35 so as to be fixed against rotation relative thereto, and are disposed between the star profiles and also between the axle journals 24, 25. One end of each of the chains 33 and 34 is fastened to the respective chain sprocket 31, 32, and the other end of the chains 33 and 34 is equipped with a crane hook 36. During transport of the screen roller 3 selected in the example at hand, the crane hook 36 of the chain 34 engages around the journal 37 of the roller 3, more precisely, between an end face of the screen roller 3 and a roller bearing 38 firmly seated on the roller journal 37, so that the roller journal 37 cannot unintentionally slip out of the crane hook 36. The drive shaft 35 is guided through the second axle journal 25 and inserted into the first axle journal 24. The drive shaft 35 is rotatably mounted in the axle journal 24, 25 by sliding bearing bushings 39 and 40.

The rotation of the chain sprockets 31, 32 and the associated winding up of the chains 33, 34 onto the chain sprockets 31, 32 or unwinding of the chains 33, 34 from the chain sprockets 31, 32 is driven by a self-locking, further worm gear mechanism including a second worm gear 41 seated firmly on the drive shaft 35 so as to be fixed against rotation relative thereto, and a second worm 42 in meshing engagement with the second worm gear 41.

The two aforementioned worm gear mechanisms, namely that for driving the turret magazine 7 and the other for driving the chain-pull mechanisms, are disposed outside the side walls 26, 27, i.e. not between the latter, and on mutually opposite sides of the turret magazine 7.

At the outer ends thereof, the carrying arms 8*a* to 11*a* and 8*b* to 10*b* are provided with quick-action closures for radially securing the screen rollers 4 to 6 against falling out of the turret magazine 7. The quick-action closures are configured as spring bolts 43 to 48 which engage behind roller bearings 49 to 51 seated on the roller journals of the secured screen rollers 4 to 6, and can be pressed or pulled back out of the holding compartments 12 to 15 counter to the spring action thereof in order to release them. Stops 52 to 54, which are disposed on the carrying arms 8*a* to 11*a* and 8*b* to 10*b*, and whereon the roller bearings 49 to 51 of the screen rollers 4 to 6 located in the turret magazine 7 rest, serve for axially securing the position of these screen rollers 4 to 6 and are disposed at each end of each holding compartment 12 to 15.

A covering shell and hood 55, respectively, manufactured from stable sheet metal extends at least approximately over the entire axial length of the turret magazine 7 and the screen rollers 3 to 6 and also over a centric angle of the turret magazine 7, which is more than 120° and approximately 135°. The covering shell 55 is mounted by side walls or cheeks 56, 57 belonging to the covering shell 55 so as to be swivellable about the rotational axis 28 of the turret magazine 7. The covering shell 55 is mounted so as to swivel about the rotational axis 28 selectively into a first swivelling position (note FIG. 1), wherein the covering shell 55 is located beneath the turret magazine 7 and abuts a stationary, immovable protective cover 58, and into a second swivelling position (note FIG. 2), wherein the covering shell 55 is located above the turret magazine 7. The protective cover 58, likewise manufactured from a stable metal sheet, extends over a centric angle of the turret magazine 7, which is less than 60° and approximately 45°, and likewise at least approximately over the entire axial length of the turret magazine 7 and of the screen rollers 3 to 6. The covering shell 55, together with the protective cover 58, forms a protective shield extending in the shape of a circular arc over a centric angle of approximately 180° in the second swivelling position, i.e., when the covering shell 55 is closed.

The invention functions in the following manner according to the illustrated exemplary embodiment:

The sheet-fed rotary press 1 is operated in printing mode in a first step. During this printing operation, one of the screen rollers 3 to 6 (in FIG. 1 this is the screen roller 3, for example) is located in the active position, wherein the corresponding screen roller 3 is located outside the turret magazine 7 and rolls on the form and/or blanket cylinder 2. The screen roller 3 located in the active position is secured by the two mutually opposite roller journals thereof, respectively, in a roller socket 59 having a quick-action closure. The quick-action closure of the illustrated roller socket 59 includes a closure ring 60 locking the roller bearing 38, and a clamping eccentric 61 attached to this closure ring 60 for clamping the roller bearing 38. During the printing operation, a metering doctor blade 62, preferably a chambered doctor blade, rests on the respective screen roller 3 located in the active position. Moreover, the covering shell 55 is held in the closed, first pivoting position thereof during the printing operation, with the result that the covering shell 55 is located between the rotating screen roller 3 and the turret magazine 7, and the two last-mentioned machine elements are protected from one another.

Thus, it is possible, completely without risk, to rotate the turret magazine 7 during an ongoing printing operation, to replace one of the screen rollers 4 to 6 held in reserve in the turret magazine 7 with another reserve roller which is to be used, for example, for a succeeding printing order, and to clean the screen rollers 4 to 6 or maintain them in another manner. The covering shell 55, which is kept closed when the sheet-fed rotary printing press 1 is running, prevents cleaning fluid, which serves for cleaning the screen rollers 4 to 6, or a tool serving for maintaining the screen rollers 4 to 6, from possibly falling onto the screen roller 3 located in the active position, or even onto the form and/or blanket cylinder 2, and causing damage as a result.

On the other hand, however, protection of the turret magazine 7 and above all of the screen rollers 4 to 6 stored therein is also ensured by the covering hood 55. The screen roller 3 displaced into the active position rotates very rapidly during the printing operation, and varnish, printing ink or coating fluid sprays or mists-off from the screen roller are not always precluded. This ink spray or mist, or the like, must not reach the screen rollers 4 to 6 held in reserve, for example because the screen rollers 4 to 6 have already been cleaned and a selected one of these screen rollers 4 to 6 is to be used, when the succeeding printing order is carried out, for metering and printing a different varnish (printing ink, coating fluid) than that of the then current printing order. The covering shell 55 provides reliable protection of the turret magazine 7 and of the screen rollers 4 to 6 located therein against contamination by the ink spray or mist.

Figure 2:
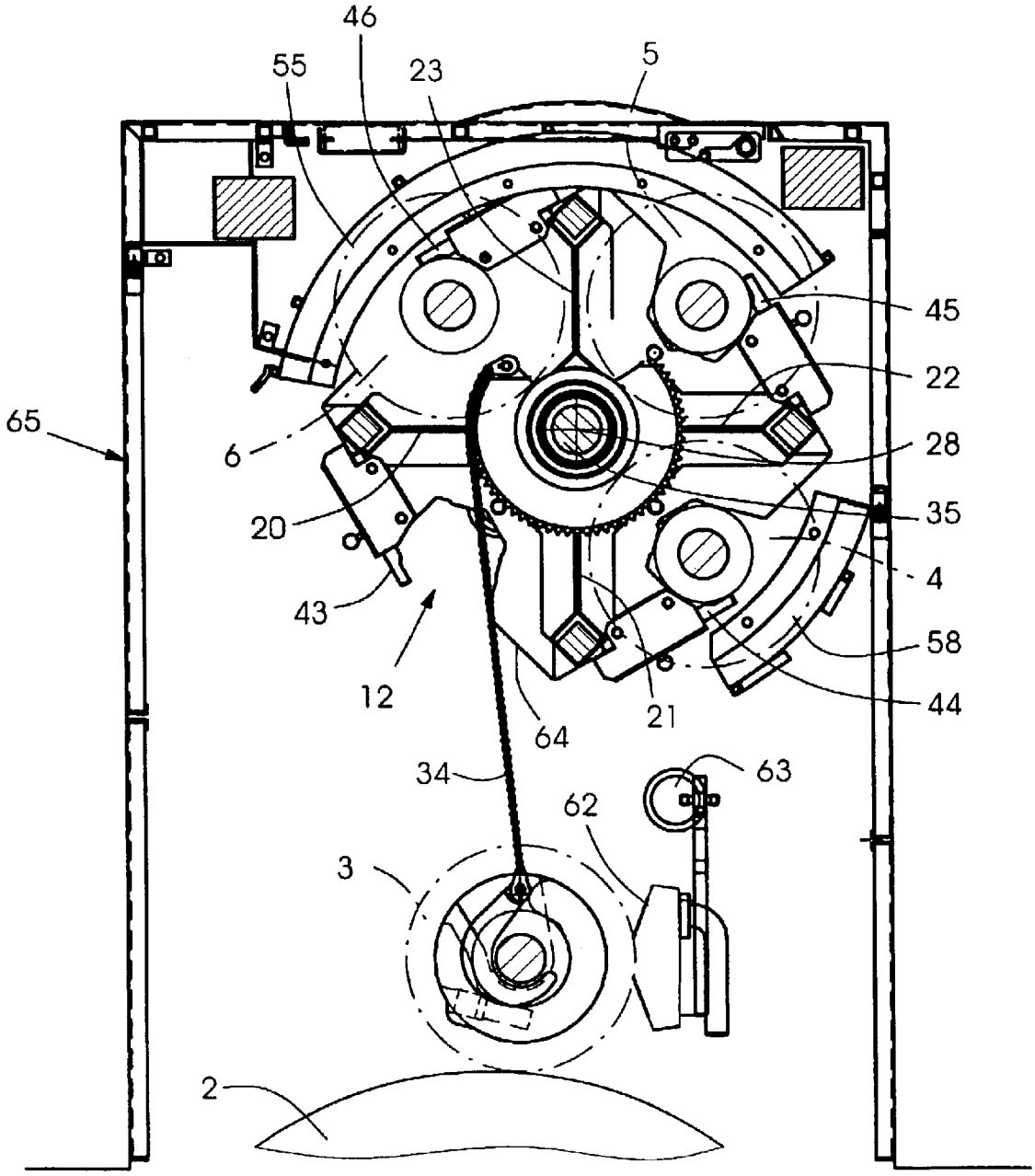
FIG. 2 is a view similar to FIG. 1, showing the rotary printing press in another operating phase wherein a roller exchange is taking place.
Figure 3:
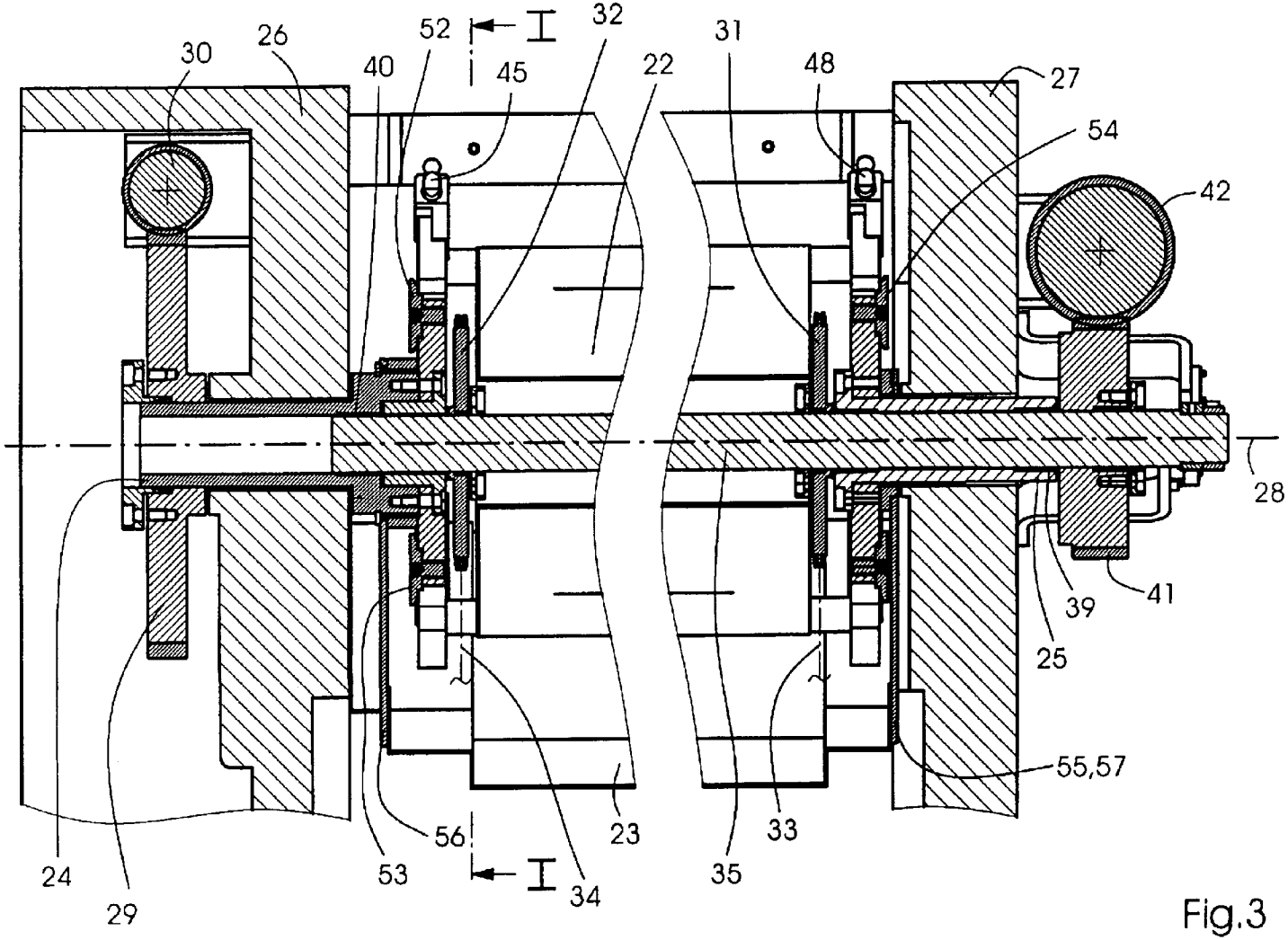
FIG. 3 is an enlarged, partly broken away, cross-sectional view of FIG. 1.
Figure 4:
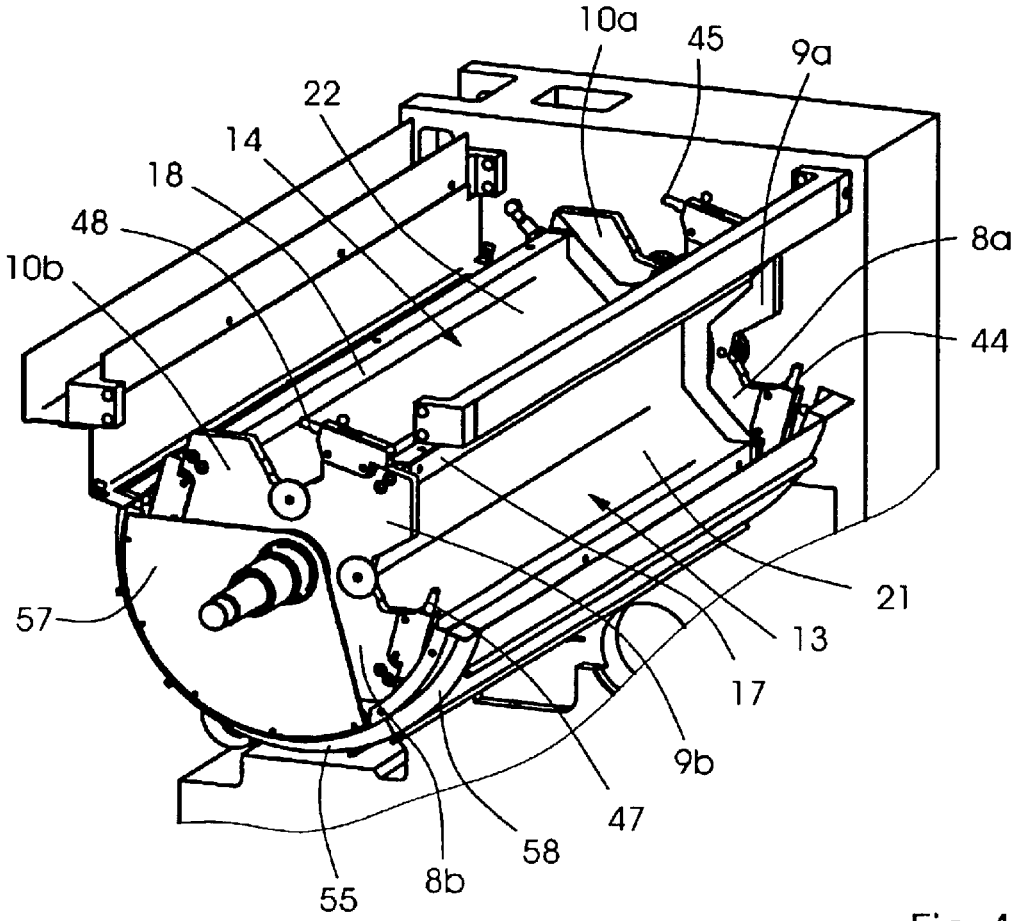
FIG. 4 is a top, side and front perspective view of the roller magazine according to the invention, without any rollers accommodated therein.

A second step, which takes place after the printing operation has been concluded and is illustrated in FIG. 2, includes exchanging the screen roller 3 with one of the screen rollers 4 to 6 which is to be used in the active position for the succeeding print order. After the sheet-fed rotary printing press 1 has been stopped, and the form and/or blanket cylinder 2 and the screen roller 3 are therefore no longer rotating, the covering shell 55 is moved from the first swivelling position thereof (note FIG. 1) into the second swivelling position thereof (note FIG. 2), with the result that the transport path between the form and/or blanket cylinder 2 and the roller socket 59, on the one hand, and the turret magazine 7, on the other hand, becomes unobstructed and is no longer blocked by the covering shell 55. The covering shell 55 is held in the second swivelling position thereof and prevented from falling closed by a gas-pressure spring (not otherwise shown in greater detail) which is connected to the covering shell 55 and also damps the swivelling movements of the covering shell 55. After the covering shell 55 has been opened, the metering doctor blade 62 is set off the screen roller 3 by a swivelling movement taking place about a rotary joint 63.

Thereafter, the chain sprockets 31, 32 are set into rotary motion (counterclockwise with respect to FIG. 2) by a motorized or manually (hand crank) driven rotation of the second worm 42 and the second worm gear 41 and the drive shaft 35, with the result that the chains 33, 34 partly wrapped or looped around the chain sprockets 31, 32 are partly unwound from the chain sprockets 31, 32 and let out of the turret magazine 7, and the crane hooks attached to the chains 33, 34 are lowered or let down to the screen roller 3. After the illustrated crane hook 36 has reached the screen roller 3 during the lowering thereof, the operator attaches the crane hook 36 to the roller journal 37.

If the drive shaft 35 is rotated manually it may possibly be necessary sometimes to turn the drive shaft 35 back a little (clockwise with respect to FIG. 2) for the purpose of correcting the unwinding length of the chain 33 so that the chain 33 tautens to the extent that the crane hook 36 remains securely engaged with the roller journal 37 and can no longer slide down off the journal 37. If the lifting device is driven manually, it is advantageous not to open the roller socket 59 until the crane hook 36 has been attached to the screen roller 3. The roller socket 59 is opened by releasing the clamping eccentric 61, and turning and thereby unlocking the closure ring 60.

In the other case, namely if the drive shaft 35 is rotated electromotively, it may be necessary to provide assurance by an electric control device, e.g. a limit switch, that the length of chain 33 which is unwound is exactly the amount required for the crane hook 36 to latch into the roller journal 37, with the result that the correction described in connection with manual drive is never required. If the lifting device (chain-pull mechanisms) is driven by motor, the roller socket 59 can be opened before the crane hook 36 is coupled with the screen roller 3.

In any event, i.e., both if the lifting device is driven manually or by motor, it is of course also possible to open the roller socket 59 before the crane hook 36 is coupled with the screen roller 3, and the roller socket 59 is open at the top after it has been opened, with the result that the screen roller 3 lies unsecured in the roller socket 59 and can be lifted through an upwardly directed removal opening 66 of the roller socket 59 by the lifting device and lifted out of the roller socket 59.

It is believed to be readily apparent that, prior to lifting the screen roller 3, the crane hook (not shown) on the chain 34 must also be coupled with the other roller journal (likewise not shown) of the screen roller 3, and the other roller socket (likewise not shown), which serves for securing this other roller journal, must be opened.

Before the screen roller 3 is transported into the turret magazine 7, the turret magazine 7 is rotated into a rotary position wherein the holding compartment 12, which is designated for accommodating the screen roller 3 and is still empty at this point, is located approximately on the transport line predefined by the tautened chains 33, 34.

The chains 33, 34 are wound back onto the chain sprockets 31, 32 again and the crane hooks are drawn up, with the screen roller 3 attached thereto, towards the turret magazine 7 by rotating the drive shaft 35 back (clockwise with respect to FIG. 2). During transport thereof, the roller bearing 38 of the screen roller 3 strikes a guide surface 64 of the turret magazine 7, the guide surface 64 being inclined towards the holding compartment 12 and disposed on the carrying arm 8*a* delimiting the holding compartment 12. Consequently, the screen roller 3, which is to be drawn into the turret magazine 7 by the lifting device, slides or rolls along the guide surface 64 towards the spring bolt 43 disposed on the opposite carrying arm 11*a* and towards the holding compartment 12. During this movement of the roller bearing 38 towards the spring bolt 43, the roller bearing 38 presses the spring bolt 43 back so that the roller bearing 38 can enter the holding compartment 12 with the spring bolt 43 pressed back. At the instant of time that this has occurred, the spring bolt 43 automatically springs back into the locking position thereof pushed forward into the holding compartment 12, with the result that the roller bearing 38 is fixed in place and enclosed in the manner of a three-point bearing between the carrying arms 16, 17 and the spring bolt 43.

The other roller bearing (not illustrated in the drawing) disposed at the other end of the screen roller 3 is secured in an analogous manner to the roller bearing 38 in the turret magazine 7 by automatic snapping-in of the corresponding spring bolt. Thereafter, the crane hooks can be released from the screen roller 3.

In order to be able to displace one of the other screen rollers, for example, the screen roller 4, into the active position in a third step, the turret magazine 7 must first of all be rotated into a rotary position wherein the holding compartment 13 occupied by the screen roller 4 lies on the imaginary transport line connecting the roller socket 59 and the turret magazine 7. After the turret magazine 7 has been aligned in this required rotary position, the crane hooks are fastened on the screen roller 4, and the spring bolts 44, 47 closing the holding compartment 13 are manually pulled back by the operator and latched in a latching notch in the pulled-back position, and thus locked. In order to perform the manipulations to be carried out on the turret magazine 7, the operator can reach into the printing unit through a window 65 formed in the latter, which can be closed by a flap.

The screen roller 4 attached to the crane hooks is lowered out of the turret magazine 7 by the lifting device and inserted into the roller socket 59, which is then closed. After the crane hooks have been released from the screen roller 4 secured in the roller socket 59, and withdrawn into the turret magazine 7, the covering shell 55 is closed again and moved back into the first swivelling position thereof shown in FIG. 1. Finally, all that is necessary is to set the metering doctor blade 62 against the screen roller 4 in order then to be able to commence the printing operation using the screen roller 4.

Possible modifications of the illustrated exemplary embodiment are explained briefly hereinafter.

It is possible to use different supple pulling members instead of the chains 33, 34, and pulleys adapted to these other pulling members instead of the chain sprockets 31, 32. For example, wire cables can be used instead of the chains 33, 34, and cable pulleys with running grooves for guiding the wire cables can be used instead of the chain sprockets 31, 32. The chains 33, 34 shown in the exemplary embodiment are, however, the most favorable with regard to precise positioning of the screen rollers.

A further modification calls for providing an applicator cylinder (or applicator roller) instead of the form and/or blanket cylinder 2, the applicator cylinder being rolled-on by the respective screen roller located in the active position, and the applicator cylinder rolling on a form and/or blanket cylinder. In other words, it is conceivable to dispose an applicator cylinder between the form and/or blanket cylinder 2 shown and the screen roller located in the active position.

We claim:

1. A printing press comprising:

a cylinder;

rollers each to be selectively displaced into an active position on said cylinder;

a roller magazine for said rollers; and a protective cover for said roller magazine, said protective cover being mounted for movable adjustment between said roller magazine and a respective one of said rollers having been displaced into said active position;

said roller magazine being disposed in an adjustable manner relative to said protective cover.

2. The printing press according to claim 1, wherein said cylinder is selected from the group consisting of form cylinders and blanket cylinders.

3. The printing press according to claim 1, wherein said rollers are screen rollers.

4. The printing press according to claim 2, wherein:

said roller magazine is a rotatably mounted turret magazine;

a lifting device is associated with said roller magazine for displacing said rollers from said roller magazine into said active position; and said lifting device has wheels mounted coaxially with said roller magazine.

5. The printing press according to claim 4, wherein said wheels are chain sprockets.

6. The printing press according to claim 5, wherein said worm gear mechanisms are disposed on mutually opposite sides of said roller magazine.

7. The printing press according to claim 4, wherein said roller magazine has a hollow axle, and said wheels of said lifting device have a drive shaft guided through said hollow axle.

8. The printing press according to claim 7, wherein said hollow axle is an axle journal.

9. The printing press according to claim 7, further comprising a worm gear mechanism connected to said drive shaft for driving said drive shaft.

10. The printing press according to claim 9, further comprising another worm gear mechanism connected to said roller magazine for driving said roller magazine.

11. The printing press according to claim 1, wherein said roller magazine is disposed in a rotationally displaceable manner relative to said protective cover.

12. A printing press comprising:

a cylinder;

rollers each to be selectively displaced into an active position on said cylinder;

a roller magazine for said rollers, maid roller magazine having an axial length; and a protective cover for said roller magazine extending substantially entirely over said axial length of said roller magazine and being mounted for movable adjustment between said roller magazine and a respective one of said rollers having been displaced into said active position.

13. The printing press according to claim 12, wherein said cylinder is selected from the group consisting of form cylinders and blanket cylinders.

14. The printing press according to claim 12, wherein said rollers are screen rollers.

15. The printing press according to claim 12, wherein:

said roller magazine is a rotatably mounted turret magazine;

a lifting device is associated with said roller magazine for displacing said rollers from said roller magazine into said active position; and said lifting device has wheels mounted coaxially with said roller magazine.

16. The printing press according to claim 15, wherein said wheel, are chain sprockets.

17. The printing press according to claim 16, wherein said worm gear mechanisms are disposed on mutually opposite sides of said roller magazine.

18. The printing press according to claim 15, wherein said roller magazine has a hollow axle, and said wheels of said lifting device have a drive shaft guided through said hollow axle.

19. The printing press according to claim 18, wherein said hollow axle is an axle journal.

20. The printing press according to claim 18, further comprising a worm gear mechanism connected to said drive shaft for driving said drive shaft.

21. The printing press according to claim 20, further comprising another worm gear mechanism connected to said roller magazine for driving said roller magazine.

* * * * *